US011384681B2

(12) United States Patent
Kothandaraman et al.

(10) Patent No.: US 11,384,681 B2
(45) Date of Patent: Jul. 12, 2022

(54) CONTROL OF AN OPPOSED-PISTON ENGINE WITH A MASS AIRFLOW SENSOR LOCATED AFTER A CHARGE AIR COOLER

(71) Applicant: ACHATES POWER, INC., San Diego, CA (US)

(72) Inventors: Govindarajan Kothandaraman, Columbus, IN (US); Hoseinali Borhan, Bloomington, IN (US); David E. Koeberlein, Columbus, IN (US); Dwight A. Doig, Columbus, IN (US)

(73) Assignee: Achates Power, Inc., San Diego, CA (US)

( * ) Notice: Subject to any disclaimer, the term of this patent is extended or adjusted under 35 U.S.C. 154(b) by 275 days.

(21) Appl. No.: 16/694,943

(22) Filed: Nov. 25, 2019

(65) Prior Publication Data

US 2021/0156298 A1 May 27, 2021

(51) Int. Cl.

| | |
|---|---|
| ***F02B 29/04*** | (2006.01) |
| ***F02B 75/28*** | (2006.01) |
| ***F02M 35/10*** | (2006.01) |
| ***F02B 25/08*** | (2006.01) |
| ***F02B 75/24*** | (2006.01) |

(52) U.S. Cl.

CPC ..... *F02B 29/0406* (2013.01); *F02B 25/08* (2013.01); *F02B 75/24* (2013.01); *F02B 75/28* (2013.01); *F02M 35/10386* (2013.01)

(58) Field of Classification Search

CPC ..... F02B 25/08; F02B 29/0406; F02B 33/34; F02B 39/10; F02B 75/24; F02B 75/28; F02B 75/282; F02D 41/18; F02D 41/222; F02D 41/0007; F02D 41/0097; F02D 2200/0402; F02M 26/03; F02M 35/10157; F02M 35/10386; G01F 1/86; G01F 25/0053; Y02T 10/12; Y02T 10/40

See application file for complete search history.

(56) References Cited

U.S. PATENT DOCUMENTS

| | | | | |
|---|---|---|---|---|
| 4,984,456 | A * | 1/1991 | Takahashi | F02D 41/185 73/114.35 |
| 8,965,628 | B2 | 2/2015 | Brevick et al. | G06F 19/00 |
| 2008/0066715 | A1 | 3/2008 | Jankovic | F02B 3/00 |

(Continued)

OTHER PUBLICATIONS

Grimes, Michael R., Verdejo, Julian R., and Bogden, Dennis M., "Development and Usage of a Virtual Mass Airflow Sensor," SAE Technical Paper 2005-01-0074, 2005.

*Primary Examiner* — Phutthiwat Wongwian
*Assistant Examiner* — Arnold Castro
(74) *Attorney, Agent, or Firm* — Terrance A. Meador

(57) ABSTRACT

An opposed-piston engine includes an electronic sensor located in a charge air channel, at position between an outlet of a charge air cooler and an air intake component that distributes charge air to cylinder intake ports of the engine. The electronic sensor is disposed to measure a rate of mass airflow between the outlet of the charge air cooler and the intake component and generate electronic signals indicative of the rate of mass airflow from the charge air cooler. A control mechanization of the opposed-piston engine is electrically connected to the electronic sensor for controlling air handling devices, fuel provisioning devices, and/or EGR devices in response to the electronic signals.

17 Claims, 4 Drawing Sheets

(56) References Cited

U.S. PATENT DOCUMENTS

| | | | | |
|---|---|---|---|---|
| 2014/0373814 | A1* | 12/2014 | Herold | F02B 75/282 123/51 B |
| 2015/0219030 | A1* | 8/2015 | Naik | F02B 29/0406 60/599 |
| 2015/0219052 | A1 | 8/2015 | Petrovic | F02M 65/00 |
| 2015/0240826 | A1* | 8/2015 | Leroy | F02D 23/005 415/1 |
| 2016/0160781 | A1 | 6/2016 | Nagar et al. | F02D 41/22 |
| 2017/0204790 | A1* | 7/2017 | Nagar | F02B 75/282 |
| 2018/0223750 | A1* | 8/2018 | Kulkarni | F02M 35/10386 |

* cited by examiner

CONTROL OF AN OPPOSED-PISTON ENGINE WITH A MASS AIRFLOW SENSOR LOCATED AFTER A CHARGE AIR COOLER

STATEMENT REGARDING FEDERALLY SPONSORED RESEARCH

This Project Agreement Holder (PAH) invention was made with U.S. Government support under Agreement No. W15KQN-14-9-1002 awarded by the U.S. Army Contracting Command-New Jersey (ACC-NJ) Contracting Activity to the National Advanced Mobility Consortium. The Government has certain rights in the invention.

FIELD OF THE INVENTION

The field is internal combustion engines, particularly uniflow-scavenged, opposed-piston engines. More specifically, the field is related to location of a mass airflow sensor in the air handling system of an opposed-piston engine.

BACKGROUND OF THE INVENTION

In a conventional four-stroke cycle, internal combustion engine, a single piston in a cylinder completes a cycle of operation during two complete revolutions of a crankshaft. During an intake stroke, movement of the piston from top to bottom dead center creates a low pressure environment that draws air into the cylinder in preparation for the following compression stroke. In this manner, the flow of gas through the engine is aided by the pumping action of the piston during the intake stroke.

In a two-stroke cycle, opposed-piston engine, two oppositely-disposed pistons in a cylinder complete a cycle of operation during a single revolution of a crankshaft. The cycle includes a compression stroke followed by a power stroke, but it lacks a distinct intake stroke during which the cylinder is charged with fresh air by movement of a piston. Instead near the end of the power stroke, pressurized fresh air enters the cylinder through an intake port near one end of the cylinder and flows toward an exhaust port near an opposite end of the cylinder as exhaust exits. Thus, gas (charge air, exhaust, and mixtures thereof) flows through the cylinder and the engine in one direction, from intake port to exhaust port. The unidirectional movement of exhaust gas exiting through the exhaust port, followed by pressurized air entering through the intake port, is called "uniflow scavenging". The scavenging process requires a continuous positive pressure differential from the intake ports to the exhaust ports of the engine in order to maintain the desired unidirectional flow of gas through the cylinders. Without this continuous positive pressure differential, combustion can falter and fail. At the same time, a high air mass density must be provided to the intake ports because of the short time that they are open. All of this requires pumping work in the engine, which is unassisted by a dedicated piston pumping stroke as in a four-stroke cycle engine.

The pumping work required to maintain the unidirectional flow of gas in an opposed-piston engine is done by an air handling system (also called a "gas exchange" system) which moves fresh air into and transports combustion gases (exhaust) out of the engine's cylinders. The air handling elements that do the pumping work may include one or more gas-turbine driven compressors (e.g., a turbocharger) and/or a pump, such as a supercharger (also called a "blower"), which may be mechanically or electrically driven. In one example, a compressor is disposed in tandem with a supercharger in a two-stage pumping configuration. The pumping arrangement (single stage, multi-stage, or otherwise) drives the scavenging process, which is critical to ensuring effective combustion, increasing the engine's indicated thermal efficiency, and extending the lives of engine components such as pistons, rings, and cylinders. Manifestly, in a two-stroke cycle, opposed-piston engine, airflow is one of the most fundamental factors by which engine operation is controlled.

For effective control of airflow, information regarding the mass of incoming air ("mass airflow") is vital to measurement of airflow conditions and to determination of precise and accurate control parameter values with which the air handling devices are actuated. Additionally, mass airflow measurement is important to controlling fuel provisioning in an opposed-piston engine equipped for fuel injection. Mass airflow measurement also plays an important role in control of exhaust gas recirculation (EGR). Parametrically, mass airflow is often expressed in SI units, for example kg/s (kilograms per second). In many instances, measurement of air mass entering the air handling system of an opposed-piston engine is enabled by an electronic mass airflow (MAF) sensor positioned in a charge air channel of the air handling system, through which charge air is transported to the intake ports of the engine's cylinders, at a point where fresh air first enters the air handling system. In a turbocharged opposed-piston engine this places the MAF sensor in the charge air channel, upstream of the compressor inlet. In cases where the charge air channel may include a supercharger as well as a turbocharger, the MAF sensor is located upstream of both charge devices. One example of such an arrangement is described in US publication 2018/0223750 A1. An alternative approach to measuring mass airflow in an opposed-piston engine is by means of a virtual mass airflow sensor, usually an algorithmically-based control routine that calculates a mass airflow value to generate a mass airflow signal, using inputs from other engine sensors. Examples of calculations used for determining mass airflow as would be used in designing a virtual MAF sensor are found in US publication 2014/0373814 A1. A virtual sensor is not a component or an element of the invention to be described.

Other means and/or locations for monitoring and measuring mass airflow in an opposed-piston engine may provide advantages related to increased precision in determination of fuel quantities, rail pressures, and start of injection that need to be commanded to a fuel injection system so as best to meet a torque demand, while controlling emissions and minimizing fuel consumption.

SUMMARY OF THE INVENTION

According to the invention, an opposed-piston engine includes an electronic sensor located in a charge air channel, at position between an outlet of a charge air cooler and an air intake component for distributing charge air to cylinder intake ports of the engine. The electronic sensor is configured and disposed to measure a rate of mass airflow between the outlet of the charge air cooler and the intake component and generate electronic signals indicative of the rate of mass airflow from the charge air cooler.

In other aspects of the invention, a control mechanization of the opposed-piston engine is electrically connected to the electronic sensor for controlling air handling devices, fuel provisioning devices, and/or EGR devices in response to the electronic signals.

DETAILED DESCRIPTION OF THE PREFERRED EMBODIMENT

Figure 1:
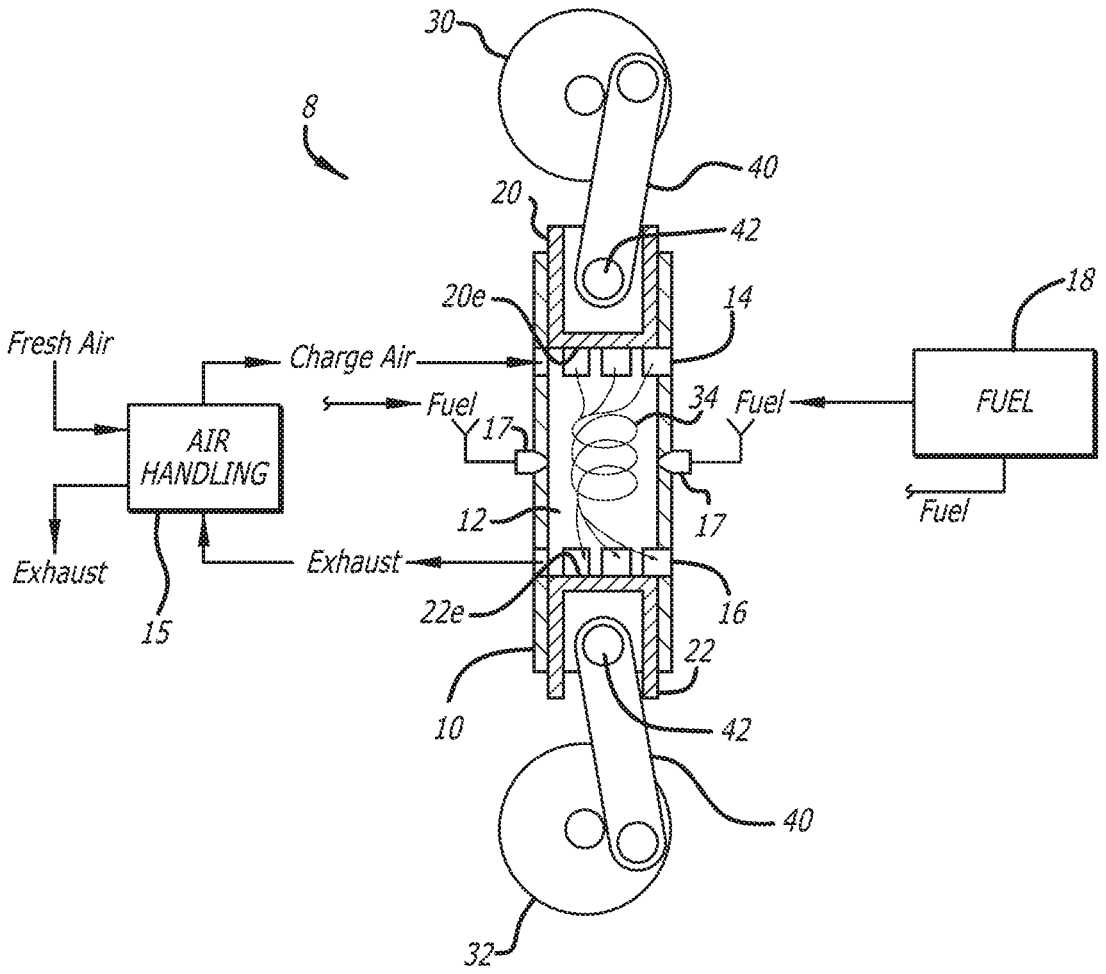
FIG. 1 is a schematic illustration of a uniflow-scavenged, two-stroke cycle, opposed-piston engine.

FIG. 1 is a schematic representation of a uniflow-scavenged, two-stroke cycle opposed-piston engine 8 of the compression-ignition type that includes at least one cylinder. Preferably, the engine 8 has two or more cylinders. In any event, the cylinder 10 represents both single cylinder and multi-cylinder configurations of the opposed-piston engine 8. The cylinder 10 includes a bore 12 and longitudinally displaced intake and exhaust ports 14 and 16 machined or formed in the cylinder, near respective ends thereof. An air handling system 15 of the engine 8 manages the transport of charge air into, and exhaust out of, the engine. Each of the intake and exhaust ports includes one or more circumferential arrays of openings in which adjacent openings are separated by a solid portion of the cylinder wall (also called a "bridge"). In some descriptions, each opening is referred to as a "port"; however, the construction of a circumferential array of such "ports" is no different than the port constructions in FIG. 1. Fuel injectors 17 include nozzles that are secured in threaded holes that open through the sidewall of the cylinder. A fuel handling system 18 of the engine 8 provides fuel for direct side injection by the injectors 17 into the cylinder. Two pistons 20, 22 are disposed in the bore 12 with their end surfaces 20*e*, 22*e* in opposition to each other. For convenience, the piston 20 is referred to as the "intake" piston because it opens and closes the intake port 14. Similarly, the piston 22 is referred to as the "exhaust" piston because it opens and closes the exhaust port 16. Preferably, but not necessarily, the intake piston 20 and all other intake pistons are coupled to a crankshaft 30 disposed along one side of the engine 8; and, the exhaust piston 22 and all other exhaust pistons are coupled to a crankshaft 32 disposed along the opposite side of the engine 8.

Operation of the opposed-piston engine 8 is well understood. In response to combustion the opposed pistons move away from locations in the cylinder 10 where they are at their innermost positions, toward their respective associated ports. While moving outwardly from their innermost locations, the pistons keep their associated ports closed until they approach respective BDC locations where they are at their outermost positions in the cylinder and their associated ports are open. The pistons may move in phase so that the intake and exhaust ports 14, 16 open and close in unison. Alternatively, one piston may lead the other in phase, in which case the intake and exhaust ports have different opening and closing times. Charge air 34 enters the cylinder 10 through the intake port 14 and flows in the direction of the exhaust port 16. Turbulence of the charge air 34 promotes air/fuel mixing, combustion, and suppression of pollutants.

Figure 2:
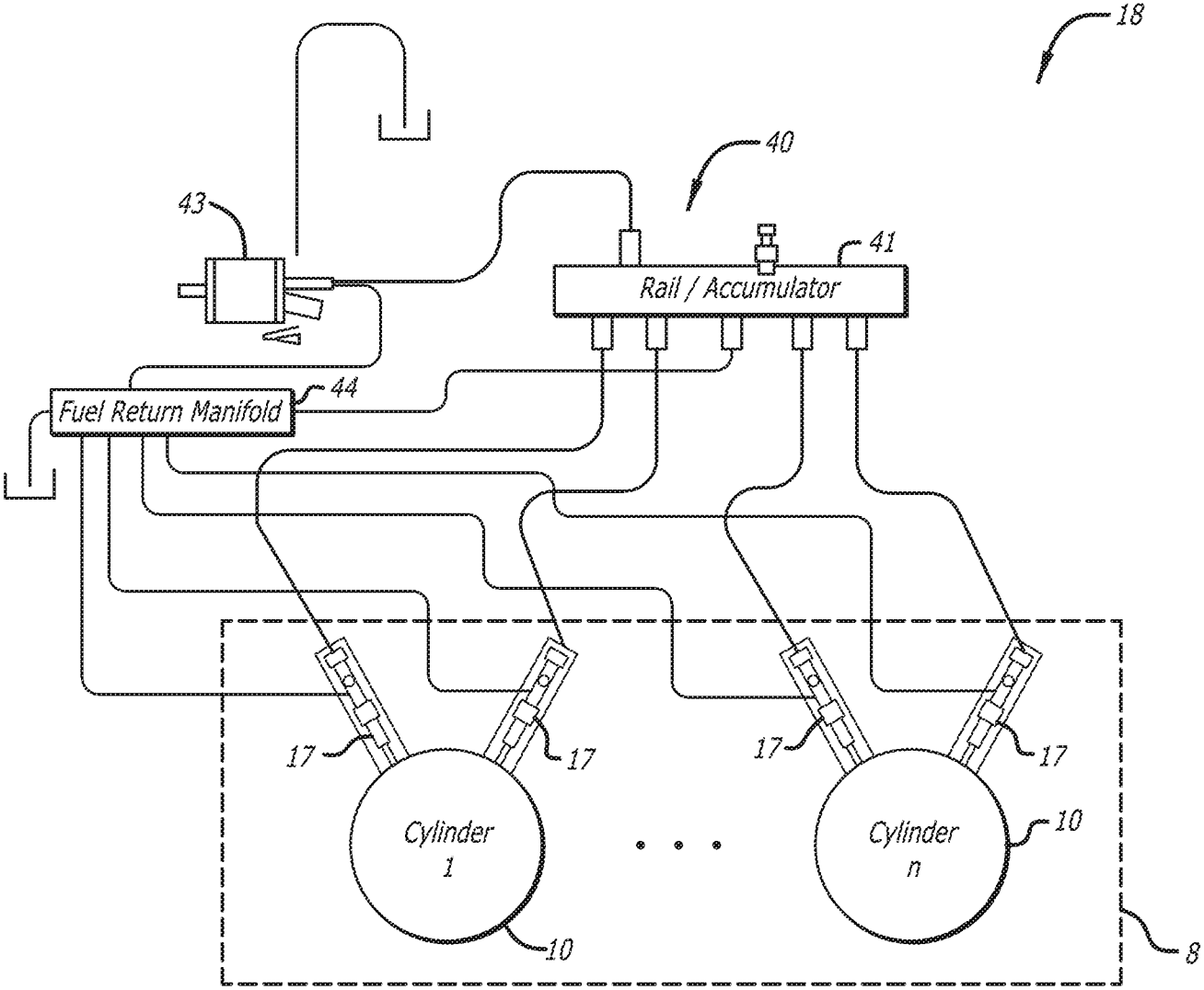
FIG. 2 is a schematic diagram illustrating a fuel injection system embodiment for the opposed-piston engine of FIG. 1.

FIG. 2 shows the fuel provisioning system 18 embodied as a common rail, direct injection fuel handling system. The fuel handling system 18 delivers fuel to each cylinder 10 by injection into the cylinder. Preferably, each cylinder 10 is provided with multiple fuel injectors mounted for direct injection into cylinder space between the end surfaces of the pistons. For example, each cylinder 10 has two fuel injectors 17. Preferably, fuel is fed to the fuel injectors 17 from a fuel source 40 that includes at least one rail/accumulator mechanism 41 to which fuel is pumped by a fuel pump 43. A fuel return manifold 44 collects fuel from the fuel injectors 17 and the fuel source 40 for return to a reservoir from which the fuel is pumped. Elements of the fuel source 40 are operated by respective computer-controlled actuators that respond to fuel commands issued by an engine control unit. Although FIG. 2 shows the fuel injectors 17 of each cylinder disposed at an angle of less than 180°, this is merely a schematic representation and is not intended to be limiting with respect to the locations of the injectors or the directions of the sprays that they inject. In a preferred configuration, best seen in FIG. 1, the injectors 17 are disposed for injecting fuel sprays in diametrically opposing directions of the cylinder 8 along an injection axis. Preferably, each fuel injector 17 is operated by a respective computer-controlled actuator that responds to injector commands issued by an engine control unit.

Figure 3:
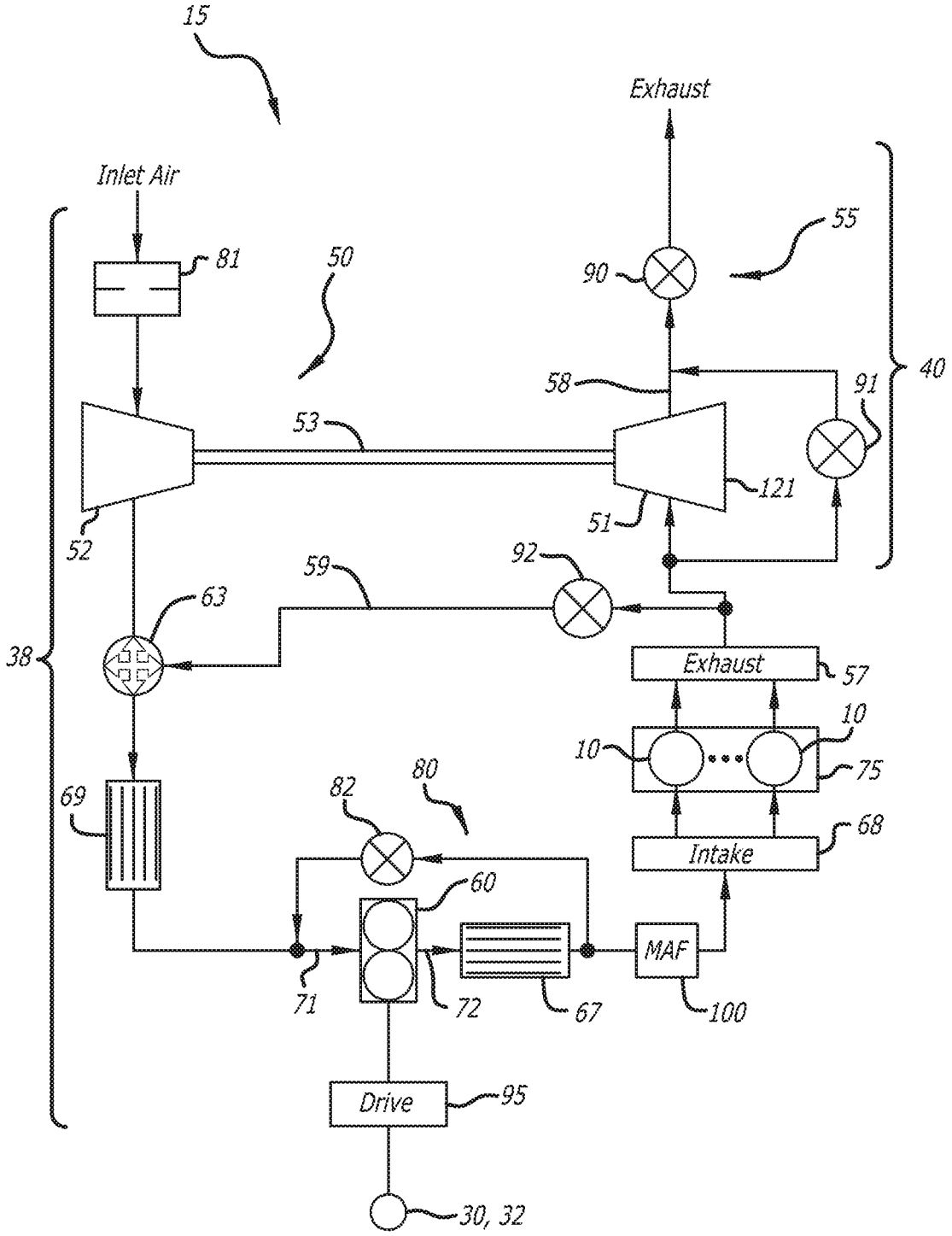
FIG. 3 is a schematic diagram illustrating an air handling system embodiment for an opposed-piston engine according to the invention.

FIG. 3 shows an exemplary embodiment of an air handling system 15 according to the invention. The air handling system 15 manages the transport of charge air provided to, and exhaust gas produced by, the opposed-piston engine 8. The air handling system construction includes a charge air subsystem 38 and an exhaust subsystem 40. In the air handling system 15, a charge air source receives fresh air and processes it into charge air. The charge air subsystem 38 receives the charge air and transports it to the intake ports of the engine 8. The exhaust subsystem 40 transports exhaust products from exhaust ports of the engine for delivery to other exhaust components.

The air handling system 15 includes a turbocharger arrangement that may comprise one or more turbochargers. For example, a turbocharger 50 includes a turbine 51 and a compressor 52 that rotate on a common shaft 53. The turbine 51 is disposed in the exhaust subsystem 40 and the compressor 52 is disposed in the charge air subsystem 38. The turbocharger 50 extracts energy from exhaust gas that exits the exhaust ports and flows into the exhaust subsystem 40 directly from engine exhaust ports 16, or from an exhaust collector 57 that collects exhaust gases output by the opposed-piston engine. In this description the exhaust collector 57 may comprise an exhaust manifold assembly attached to a cylinder block 75 of the opposed-piston engine or an exhaust plenum or chest formed with the cylinder block 75 that communicates with the exhaust ports 16 of all cylinders 10, which are supported in the cylinder block 75, The turbine 51 is rotated by exhaust gas passing through it to an exhaust outlet 58. This rotates the compressor 52, causing it to generate charge air by compressing fresh air.

Exhaust gases from the exhaust ports of the cylinders 50 flow from the exhaust collector 57 into the inlet of the turbine 51, and from the turbine's outlet into an exhaust outlet channel 55. In some instances, one or more after-treatment devices (not shown) may be provided in the exhaust outlet channel 55. The air handling system 15 may be constructed to reduce NOx emissions produced by combustion by recirculating exhaust gas through the ported cylinders of the engine by way of an exhaust gas recirculation (EGR) loop 59. If the air handling system is equipped with EGR, exhaust gas transported through the EGR loop 59 is mixed with charge air in a mixer 63 positioned in the charge air subsystem, downstream of the outlet of the compressor 52

The charge air subsystem may provide ambient inlet air to the compressor 52 via an air filter 81. As the compressor 52 rotates it compresses the ambient inlet air. The compressed air flows into the inlet of the supercharger 60. Air pumped by the supercharger 60 flows through the supercharger's outlet to an inlet of a charge air cooler 67, and from the outlet of the charge air cooler 67 into an air intake component 68. Pressurized charge air is distributed by the air intake component 68 to the intake ports 14 of the cylinders 10. In this description the air intake component 68 may comprise an intake manifold assembly attached to the cylinder block 75, or an intake plenum or chest formed with the cylinder block 75 that communicates with the intake ports 14 of all cylinders 10, which are supported in the cylinder block 75.

The charge air subsystem includes at least one cooler coupled to receive and cool charge air before delivery to the intake ports of the engine 8. In this regard, the charge air cooler 67 is provided between the outlet of the supercharger 60 and the air intake component 68. In some instances, charge air output by the compressor 52 may flow through another cooler 69, positioned in the charge air channel downstream of a mixer in which charge air flowing from the outlet of the compressor 52 is mixed with whence it is pumped by the supercharger 60 to the intake ports.

With further reference to FIG. 3, the exemplary air handling system 15 is equipped for control of gas flow at various control points in the charge air and exhaust subsystems. In the charge air subsystem, charge air flow and boost pressure are controlled by operation of a shunt path 80 coupling the outlet of the supercharger to the supercharger's inlet. The shunt path 80 includes a shunt valve 82 that governs the flow of charge air into, and thus the pressure in, the intake component 68. More precisely, the shunt valve 82 shunts the charge air flow from the supercharger's outlet (high pressure) to its inlet (lower pressure). Note that the shunt path 80 may shunt the outlet of the charge air cooler 67 to the inlet of the supercharger 60, as seen in FIG. 3, or may omit the charge air cooler 67 and shunt the outlet of the supercharger 60 to its inlet; the precise configuration of the shunt loop 80 would be a matter of design choice. Sometimes those skilled in the art refer to the shunt valve 82 as a "bypass" valve or a "recirculation" valve. A backpressure valve 90 in the exhaust channel 55 governs the flow of exhaust out of the turbine and thus the backpressure in the exhaust subsystem for various purposes, including modulation of the exhaust temperature. As per FIG. 3, the backpressure valve 90 is positioned in the exhaust channel 55, between the output 58 of the turbine 51 and the after-treatment devices 79. A wastegate valve 92 diverts exhaust gases around the turbine blade, which enables control of the speed of the turbine. Regulation of the turbine speed enables regulation of the compressor speed which, in turn, permits control of charge air pressure. An EGR valve 92 controls the amount of exhaust gas that is recirculated by the EGR loop 59 to the charge air channel. The valves 82, 90, 91, and 92 are opened and closed by respective computer-controlled actuators that respond to rotational commands issued by an engine control unit. In some cases, these valves may be controlled to two states: fully opened or fully closed. In other cases, any one or more of the valves may be variably adjustable to a plurality of states between fully opened and fully closed.

In some instances, additional control of gas flow and pressure is provided by way of a variable speed supercharger. In these aspects, the supercharger 60 is coupled by a drive mechanism 95 to a crankshaft 30 or 32 of the engine 8, to be driven thereby. The drive mechanism 95 may comprise a stepwise transmission device, or a continuously variable transmission device (CVD), in which cases charge air flow, and boost pressure, may be varied by varying the speed of the supercharger 60 in response to a speed control signal provided to the drive mechanism 95. In other instances, the supercharger may be a single-speed device with a mechanism to disengage the drive, thus giving two different drive states. In yet other instances, a disengagement mechanism may be provided with a stepwise or continuously variable drive. In any event, the drive mechanism 95 is operated by a computer-controlled actuator that responds to drive commands issued by an engine control unit.

In some aspects, the turbine 51 may be a variable-geometry turbine (VGT) device having an effective aspect ratio that may be varied in response to changing speeds and loads of the engine. Alteration of the aspect ratio enables control of the speed of the turbine. Regulation of the turbine speed enables regulation of the compressor speed which, in turn, permits control of charge air boost pressure. Thus, in many cases, a turbocharger comprising a VGT may not require a wastegate valve. A VGT device is operated by a computer-controlled actuator that responds to turbine commands issued by an engine control unit.

As seen in FIG. 3, the invention concerns placement of an electronic sensor 100 disposed to measure a rate of mass airflow between the outlet of the charge air cooler 67 and the intake component 68 and generate electronic signals indicative of the rate of mass airflow. The electronic senor is a mass airflow (MAF) sensor 100 that is disposed, placed, installed, located, or positioned in the charge air channel 38 between the outlet of the charge air cooler 67 and the inlet of the intake component 68. Thus the mass airflow measured by the MAF sensor 100 is in the portion of the charge air channel 38 that is downstream of a compressor disposed in tandem with a supercharger in a multi-stage pumping configuration operative to provide charge air to an inlet of the charge air cooler 67. In essence, the MAF sensor, at the location shown in FIG. 3, measures a mass flow rate of charge air delivered to the intake ports of the opposed-piston engine 8. This parameter should reflect the mass flow rate of fresh air entering the engine; if EGR is employed, the parameter should reflect the mass flow rate of fresh air entering the engine, plus the mass flow rate of recirculated exhaust gas. In either case, the airflow parameter measured by the MAF sensor 100 has many uses. Such uses may include: determination of an amount of fuel to be injected by the fuel injection system (see US 2017/0204790); diagnosis of air handling components (see US 2016/0160781); control of EGR flow (see US 2014/0373814); and other uses. These and other functions are carried out by an engine control mechanization and employed thereby to control the air handling and fuel provisioning systems, as well as other engine systems.

Figure 4:
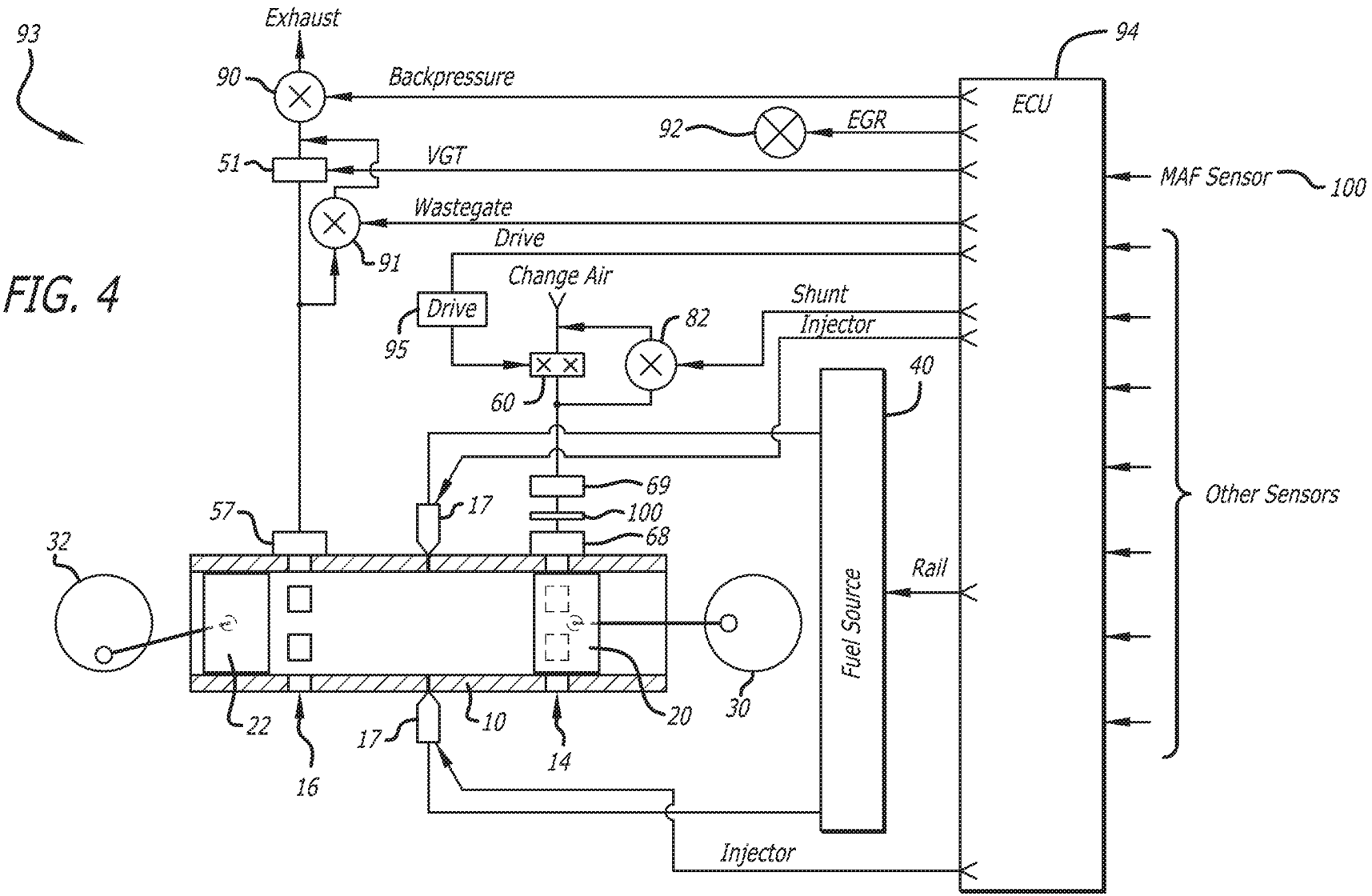
FIG. 4 is a schematic diagram illustrating a control mechanization embodiment for an opposed-piston engine according to the invention.

In this disclosure, and with reference to FIG. 4, an engine control mechanization 93 is a computer-based system that governs the operations of various engine systems, including the fuel provisioning system, the air handling system, a cooling system, a lubrication system, and other engine systems based on inputs from the MAF sensor 100 and other engine sensors. The engine control mechanism 93 includes one or more electronic control units coupled to associated sensors, actuators, and other machine devices throughout the engine. As per FIG. 4, control of the fuel handling system of FIG. 2 and the air handling system of FIG. 3 (and, possibly, other systems of the opposed-piston engine 8) is implemented by the engine control mechanization 93, based on electrical signals from the MAF sensor 100 indicative of a rate of mass airflow between the outlet of the charge air cooler 67 and the intake component 68. In response to signals from the MAF sensor and one or more of the other engine sensors, commands are generated for actuation of one or more air handling devices and/or fuel provisioning devices. The control mechanization 93 includes a programmable engine control unit (ECU) 94 programmed to execute air handling algorithms and fuel provisioning algorithms under various engine operating conditions. Such algorithms are embodied in control modules that are part of an engine systems control program executed by the ECU 94 while the engine is operating.

For the air handling system, the ECU 94 controls one or more air handling devices by issuing backpressure (Backpressure), wastegate (Wastegate), EGR, and shunt (Shunt) commands to actuate the exhaust backpressure valve 90, the wastegate valve 91, the EGR valve 92, and the supercharger shunt valve 82, respectively. In cases where the supercharger 60 is operated by a variable drive, the ECU 94 also controls this air handling device by issuing drive (Drive) commands to actuate the supercharger drive 95. And, in those instances where the turbine 51 is configured as a variable geometry device, the ECU 94 also causes actuation of this air handling device by issuing VGT commands to set the aspect ratio of the turbine.

For the fuel provisioning system, the ECU 94 controls injection of fuel into the cylinders by issuing rail pressure (Rail) commands to actuate the fuel source 40, and by issuing injector (Injector) commands to actuate the injectors 17.

When the opposed-piston engine 8 runs, the ECU 94 determines the current engine operating state based on engine load and engine speed, and governs the amount, pattern, and timing of fuel injected into each cylinder 10 by control of the common rail fuel pressure and injection duration, based on the current operating state. For this purpose, the ECU 94 may receive signals from other engine sensors which may include an accelerator sensor, a speed governor, or a cruise control system, or equivalent means that detects accelerator position, an engine speed sensor that detects the rotational speed of the engine, and a pressure sensor that detects rail pressure. The ECU 94 configures the air handling system 15 to provide the optimal AFR for the current operational state. For this purpose, in addition to the MAF sensor 100, the ECU receives electrical signals from other engine sensors that may include pressure and temperature sensors that detect ambient air pressure and temperature upstream of the inlet of the compressor 52, pressure and temperature sensors that detect charge air pressure and temperature upstream of the inlet of the supercharger 60, intake pressure and temperature sensors that detect charge air pressure and temperature at the inlet of the air intake component 68, exhaust pressure and temperature sensors that detect exhaust pressure and temperature at the outlet of the exhaust collector 57, exhaust pressure and temperature sensors that detect exhaust pressure and temperature downstream of the outlet of the turbine, and, possibly other sensors.

As will be evident to the reasonably skilled craftsman, although the invention has been described with reference to presently preferred examples and embodiments, it should be understood that various modifications can be made without departing from the scope of the following claims.

The invention claimed is:

1. An opposed-piston engine, comprising:

an air intake component for distributing charge air to one or more cylinder intake ports of the engine;

a charge air cooler having an outlet in airflow communication with the air intake component;

a compressor disposed in tandem with a supercharger in a multi-stage pumping configuration operative to provide charge air to an inlet of the charge air cooler;

an electronic sensor disposed to measure a rate of mass airflow between the outlet of the charge air cooler and the intake component and generate electronic signals indicative of the rate of mass airflow; and, a control mechanization electrically connected to the electronic sensor for causing actuation of one or more air handling devices in response to the electronic signals.

2. The opposed-piston engine of claim 1, wherein the one or more air handling devices comprise a supercharger drive and a supercharger recirculation valve.

3. The opposed-piston engine of claim 1, wherein the one or more air handling devices comprise a variable-geometry turbine.

4. The opposed-piston engine of claim 1, wherein the one or more air handling devices comprise a turbine wastegate valve and an exhaust backpressure valve.

5. The opposed-piston engine of claim 1, wherein the one or more air handling devices include an EGR valve.

6. The opposed-piston engine of claim 2, wherein the one or more air handling devices comprise a variable-geometry turbine.

7. The opposed-piston engine of claim 6, wherein the one or more air handling devices comprise a turbine wastegate valve and an exhaust backpressure valve.

8. The opposed-piston engine of claim 7, wherein the one or more air handling devices include an EGR valve.

9. The opposed-piston engine of any one of claims 1-8, wherein the air intake component for distributing charge air to one or more cylinder intake ports of the engine comprises one of an intake air chest formed in a cylinder block of the opposed-piston engine and a manifold coupled to the cylinder block of the opposed-piston engine.

10. An opposed-piston engine, comprising:

an air intake component for distributing charge air to one or more cylinder intake ports of the engine;

a charge air cooler having an outlet in airflow communication with the air intake component;

a compressor disposed in tandem with a supercharger in a multi-stage pumping configuration operative to provide charge air to an inlet of the charge air cooler;

an electronic sensor disposed to measure a rate of mass airflow between the outlet of the charge air cooler and the intake component and generate electronic signals indicative of the rate of mass airflow; and, a control mechanization electrically connected to the electronic sensor for causing actuation of one or more fuel provisioning devices in response to the electronic signals.

11. The opposed-piston engine of claim 10, wherein the one or more fuel provisioning devices comprise at least one common fuel rail, at least one fuel pump, and at least one fuel injector.

12. The opposed-piston of claim 11, wherein the control mechanization is further electrically connected to the electronic sensor for causing actuation of one or more air handling devices in response to the electronic signals.

13. The opposed-piston engine of claim 12, wherein the one or more air handling devices comprise a variable-geometry turbine.

14. The opposed-piston engine of claim 12, wherein the one or more air handling devices comprise a turbine wastegate valve and an exhaust backpressure valve.

15. The opposed-piston engine of claim 12, wherein the one or more air handling devices include an EGR valve.

16. The opposed-piston engine of claim 12, wherein the one or more air handling devices comprise a supercharger drive and a supercharger recirculation valve.

17. The opposed-piston engine of any one of claims 10-16, wherein the air intake component for distributing charge air to one or more cylinder intake ports of the engine comprises one of an intake air chest formed in a cylinder block of the opposed-piston engine and a manifold coupled to the cylinder block of the opposed-piston engine.

* * * * *